United States Patent [19]

Martin et al.

[11] 4,063,567

[45] Dec. 20, 1977

[54] TENT PEG

[76] Inventors: Claude Martin, R.R. No. 2, Garthby; Real Martin, 1206 St. Louis Street, Thetford Mines, both of County of Frontenac, Quebec, Canada

[21] Appl. No.: 617,533

[22] Filed: Sept. 29, 1975

[30] Foreign Application Priority Data

Oct. 3, 1974 United Kingdom ..... 42899/74

[51] Int. Cl.[2] ..... A45F 1/16

[52] U.S. Cl. ..... 135/15 PE; 52/154

[58] Field of Search ..... 135/15 PE; 52/148, 154, 52/166

[56] References Cited

U.S. PATENT DOCUMENTS

| | | | |
|---|---|---|---|
| 484,998 | 10/1892 | Comstock | 135/15 PE |
| 1,592,128 | 7/1926 | Steinbreder | 135/15 PE |
| 1,661,867 | 3/1928 | Armstrong | 135/15 PE |
| 2,817,346 | 12/1957 | Whitney | 135/15 PE |
| 3,280,829 | 10/1966 | Glendenning et al. | 135/15 PE |
| 3,732,878 | 5/1973 | Blaukenmeyer et al. | 135/15 PE |
| 3,758,062 | 9/1973 | Caldwell et al. | 135/15 PE X |
| 3,788,336 | 1/1974 | Steffes | 135/15 PE |

FOREIGN PATENT DOCUMENTS

| | | | |
|---|---|---|---|
| 537,312 | 4/1955 | Belgium | 135/15 PE |
| 58,619 | 11/1937 | Norway | 135/15 PE |

*Primary Examiner*—Werner H. Schroeder
*Assistant Examiner*—Conrad L. Berman

[57] ABSTRACT

A tent peg to positively prevent collapse of a tent under strong winds. The tent peg has a straight elongated body and a short angularly directed branch near the upper end thereof, adapted to be set to the vertical to be inserted within and attached to a tubular tent post to prevent its horizontal and vertical displacement. The tent peg is further provided with means to resist its pulling off the ground. These means include teeth on the body and the fact that in one embodiment of the peg, the body has a V-shape cross-section tapering towards its ground-engaging pointed end, whereby trapping earth, which resists pulling. The peg is provided with means for attaching tent cords, tent metal eyelets to further maintain the tent in erected position. The peg is also provided with means to interconnect it with another peg driven at an angle forming a V-shape arrangement within the ground to further resist pulling the peg off the ground.

5 Claims, 8 Drawing Figures

TENT PEG

The present invention relates to a tent peg and, more particularly, to a tent peg adapted to be used in conjunction with tents of the type incorporating posts or metallic tubular structures maintaining the tent in erected position.

In conventional tent constructions, the tent fabric is supported by posts simply resting on the ground, tent cords acting as guy wires and attached tent pegs around the tent and further tent pegs holding down the tent walls along the lower edges. Under severe wind conditions, the tent fabric is pushed sideways and blown upwardly and the supporting posts are uplifted and jarred out of position, resulting in the collapse of the tent.

The main object of the invention is to provide a tent peg which will obviate the above-noted disadvantage.

A more specific object of the invention is to provide a tent peg having means to secure the tent post against horizontal and also vertical movement.

Another object of the invention is to provide a tent peg which has means to resist pulling off the ground.

Another object of the invention is to provide a tent peg of the present invention which is easy and fast to manufacture and is therefore inexpensive.

The foregoing and other objects of the invention will become more apparent during the following disclosure and by referring to the drawings, in which.

In the drawings, like reference characters indicate like elements throughout.

The peg in accordance with FIGS. 1 to 4A is of sheet metal construction and can be punched out in one operation. It consists of an elongated body 1 having a ground-engaging lower pointed end 2, preferably of V-shape, and an upper end portion 3 adapted to protrude from the ground.

Figures 1, 2, 3, 4, 4A:
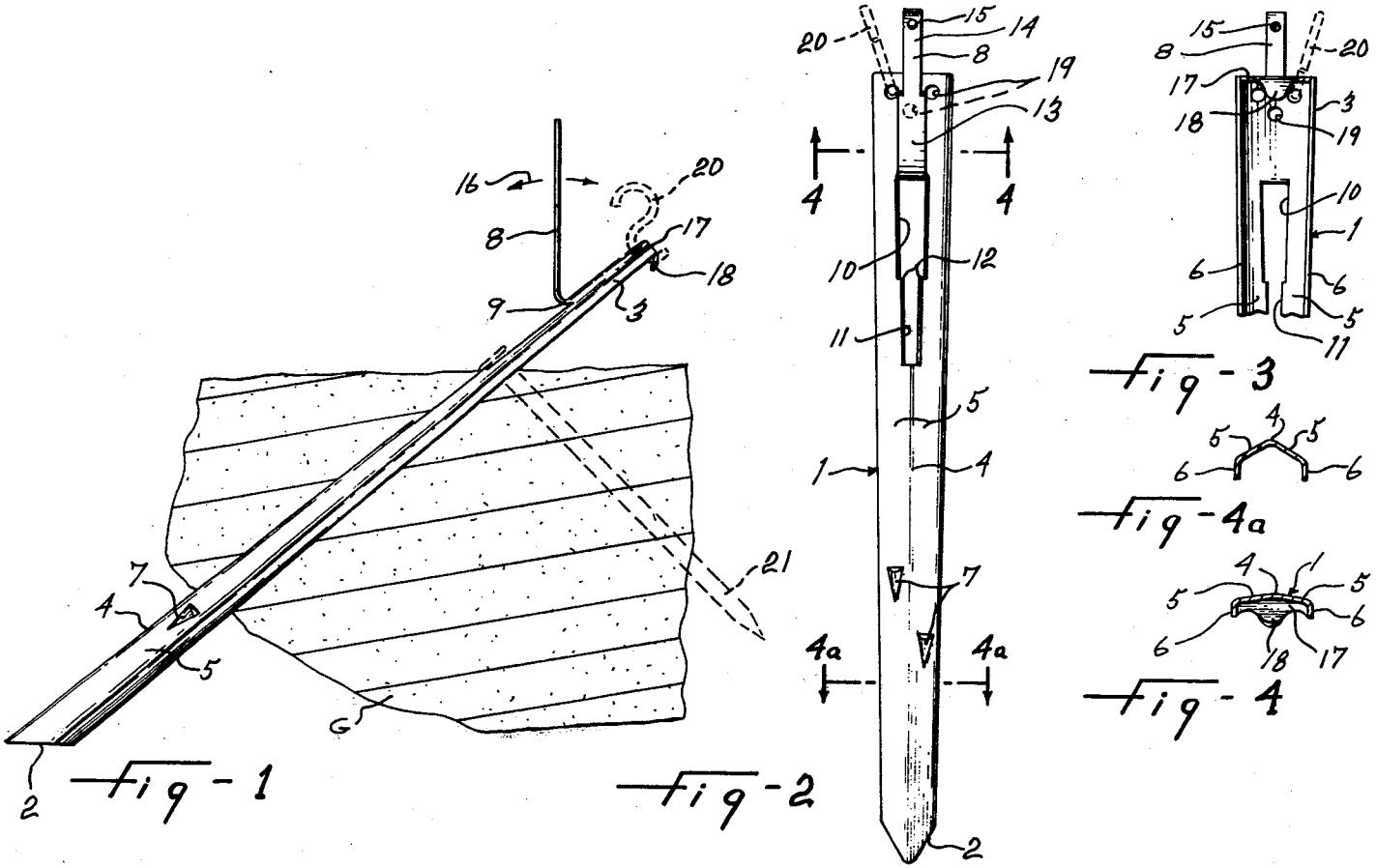
FIG. 1 is a side elevation of a tent peg in accordance with the invention, in operative position driven into the ground.
FIG. 2 is a front elevation of the same tent peg.
FIG. 3 is a partial elevation from the back side.
FIG. 4 is a cross-section along line 4—4 of FIG. 2.
FIG. 4A is a cross-section along line 4A—4A of FIG. 2.

In cross-section, it has a V-shape defining a central ridge 4 and angularly directed wings 5, each extended along their outer edges by a flange 6, the two flanges 6 being substantially parallel transversely thereof. The body 1 tapers towards the pointed end 2, as shown in FIG. 2, and the angle subtended by the wings 5 becomes progressively less towards the pointed end 2, so that the body gradually increases in depth towards the pointed end 2, as shown in FIG. 1.

Once driven into the ground G. the earth fills the cavity defined between the wings 5 and the flanges 6. This earth resists upward pull on the body 1, as it tends to be compressed by the flanges 6 of the tapered body 1. To resist further pulling off, teeth 7 are struck out from the body 1 in its lower region, the teeth being of partially conical shape and having their base upwardly directed towards the upper end 3.

In accordance with the main feature of the invention, a branch 8 depends from body 1 at the upper portion of the latter and is directed at a acute angle thereto upwardly from body 1.

In the embodiment shown, branch 8 is in the form of a tongue struck out from body symmetrically along the ridge 4 and bent upwardly at a acute angle at the top edge 9 of the aperture 10 so formed. The aperture 10 is of elongated shape with a lower restricted portion 11 forming upwardly directed side shoulders 12. The shape of the tongue is accordingly formed of a main section 13 adjacent the top edge 9 with a narrower terminal section 14. The upper end of the latter has preferably. a circular hole 15. The angle of tongue 8 can be manually adjusted, as indicated by arrows 16, so that with body 1 driven into the ground at a suitable inclination, branch 8 can be bent to extend substantially vertically. It is meant to be located just above ground and be inserted within the lower open end of a tent supporting post.

The post can be provided with transversely aligned holes and a pin, or the like, inserted therethrough and also through hole 15, so as to lock the lower end of the post not only against horizontal displacement but also directly against upward movement.

The upper end of body 1 is provided with an integral closure flange 17 extending at right angles to the long axis of the body and forming a hammering surface located above the junction of tongue 8 with body 1. A central tab 18 projects from flange 17 and can be manually bent downwardly to serve as a hook for a tent cord or the like.

The closure flange 17 serves also to reinforce the body 1 and maintain the same in its intended shape. Finally, the top portion of the body 1 has a plurality of circular holes 19, for the insertion of a standard S-shape hook 20, designed to be hooked into the metal eyelets or grommets found at the lower edge of the tent walls. Instead of an S-shape hook 20, a permanently attached hook rotatably mounted in one of the holes 19 can be provided for the same purpose.

To further lock the tent peg against upward displacement, a nail 29, or any other suitable peg, is inserted through aperture 10, and driven into the ground to make an angle with body 1, so as to lock body 1 in position. The locking peg 21 abuts against the shoulders 12, being driven through the main aperture portion 10. Whenever the tent peg is used to attach only either the tent cords or the lower end of a tent wall through the grommets thereof, the tongue or branch 8, can be left unfolded within the aperture 10.

It has been found that guy wire type tent cords can be dispensed with, thereby eliminating obstructions around the tent by using the tent peg of the invention. In the case of a shelter type tent with only a roof and no walls, the supporting posts are anchored to the tent pegs as previously described and crossed tent cords are run from the top end of one post to the lower end of an adjacent post to be attached to the associated peg. In the case of a complete tent, with the walls and posts attached to the pegs, the walls themselves maintain the posts upright.

Figure 5:
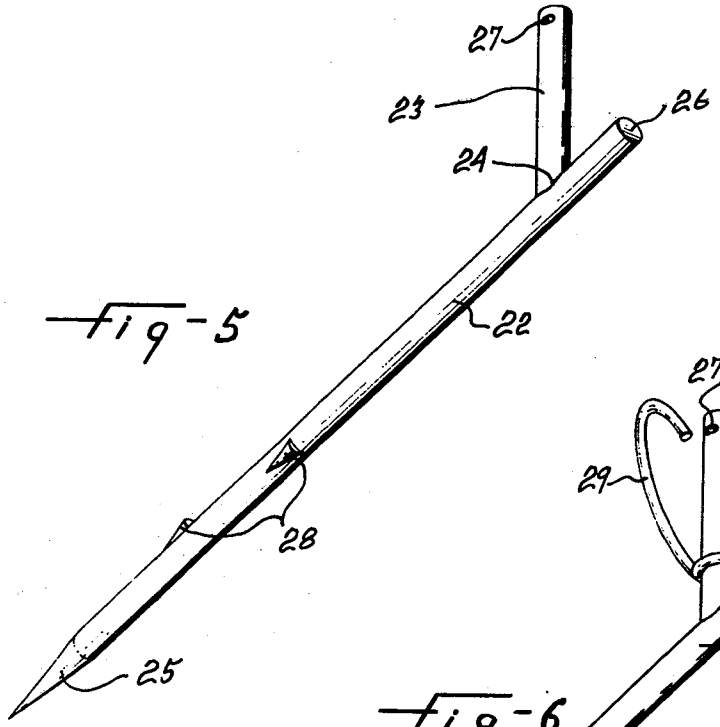
FIG. 5 is a perspective view of a second embodiment.

The embodiment of FIG. 5 shows a tent peg consisting of an elongated body 22 and a side branch 23, welded or otherwise secured at 24 to the upper end portion of body 22 and upwardly inclined to make an acute angle with the main branch.

Both body 22 and branch 23 are welded together and are made of rod steel. Body 22 is straight and has a lower gound-engaging pointed end 25, while its top end 26 is flat and designed to be hammered down into the ground. The outer end of branch 23 is preferably provided with a through bore 27. Body 22 is formed with ground-retaining teeth 28. Here again, the peg is driven into the ground so that body 22 will be at an incline and branch 23 substantially vertical or upright and disposed above ground to be inserted within the lower end of a tent supporting tubular post. The post can be anchored against upward movement by passing a transverse pin through bore 27 and align holes made in the post.

Figure 6:
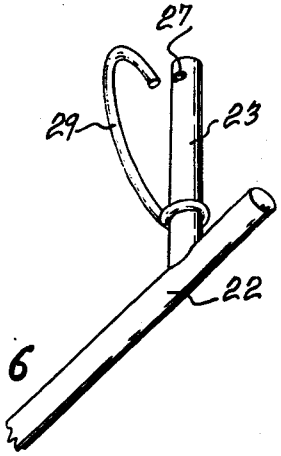
FIG. 6 is a partial perspective view of a third embodiment.

FIG. 6 shows a modification of FIG. 5 in that branch 23 is further provided with a wire hook 29, secured thereto, for hooking onto a metal eyelet, or grommet, found at the lower edge of the side walls of the tent fabric.

The hook 29 can also be used to attach a tent cord.

Figure 7:
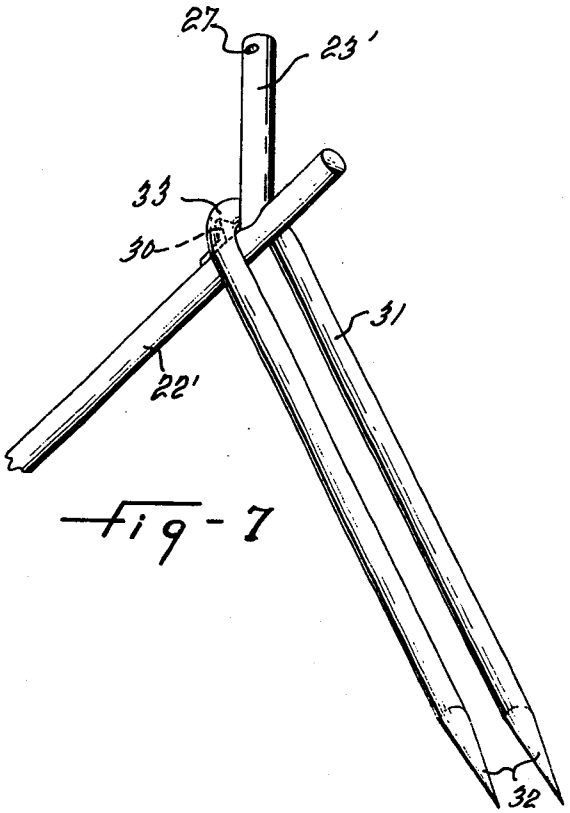
FIG. 7 is a partial perspective view of a fourth embodiment associated with a locking peg.

FIG. 7 shows how the tent peg of either FIG. 5 or 6 can be provided with a shelf 30, welded or otherwise secured to body 22' in alignment with branch 23', but slightly spaced downwardly therefrom to serve as an abutment for locking peg 31 driven into the ground at an angle to main peg 22 and in the form of a U-shaped element with pointed ends 32 on both legs thereof with the bight 33 of the locking peg 31 surrounding the body 22' and held against longitudinal movement between the shelf 30 and branch 23'. Thus, upward or downward movement of the main peg is positively prevented. The secondary peg 31 has the same function as the nail 21, shown in FIG. 1.

If desired, a wire hook, such as the hook 29 of FIG. 6, can be directly attached to the bight 33 of the double legged peg 31.

What I claim is:

1. A tent peg comprising an elongated rigid body adapted to be angularly driven into the ground and having a lower pointed end and a flat upper end, the latter serving to hammer said body into the ground, a straight short branch secured to, and joining with, said body in a zone spaced below said upper end and proximate said upper end, said branch making an obtuse angle with the portion of said body located below said zone, said branch adapted to be vertically and upwardly directed when the body is angularly positioned in the ground, so as to be inserted in the open tubular lower end of a tent-supporting post to prevent lateral displacement of said post lower end, said branch having an upper end portion provided with a transverse bore for receiving a pin extending through transversely aligned holes made in said tubular lower end of said post to lock said post against upward movement.

2. A tent peg as claimed in claim 1, wherein said body is made of sheet metal and said branch is an integral sheet metal tongue struck out from said body and is bendable to adjustable vary said obtuse angle, so as to cause said branch to be vertically upwardly directed irrespective of variations of the angular position of said body in the ground.

3. A tent peg as claimed in claim 1, further including tent cord hooking means formed at said upper end of said body.

4. A tent peg as claimed in claim 1, wherein said body is made of sheet metal and said branch is an integral sheet metal tongue struck out from said body, said body having a generally V-shaped cross-section and is slightly tapering towards the pointed lower end, said body defining side wings diverging from each other with the angle included between said side wings progressively decreasing from said upper end to said lower end of said body, wherein the depth of said body progressively increases towards its pointed lower end, said wings further being extended at their free side edges by a flange, the two flanges being substantially parallel to each other along the length of said body.

5. A tent peg as claimed in claim 1, further including a shelf-like projection carried by said body in substantial coplanar relation with said branch and slightly spaced downwardly therefrom, and a U-shape locking peg surrounding said first-named peg at an angle thereto with the bight of said locking peg engaged between said branch and said shelf-like projection.

* * * * *